US010502090B2

(12) United States Patent
Betancourt et al.

(10) Patent No.: US 10,502,090 B2
(45) Date of Patent: Dec. 10, 2019

(54) BORESCOPE PLUG

(71) Applicant: United Technologies Corporation, Farmington, CT (US)

(72) Inventors: Fabian D. Betancourt, Meriden, CT (US); Amarnath Ramlogan, Glastonbury, CA (US); Lisa P. O'Neill, Manchester, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 653 days.

(21) Appl. No.: 15/231,023

(22) Filed: Aug. 8, 2016

(65) Prior Publication Data

US 2018/0038241 A1 Feb. 8, 2018

(51) Int. Cl.

| | |
|---|---|
| ***F01D 21/00*** | (2006.01) |
| ***F01D 9/04*** | (2006.01) |
| ***F01D 11/00*** | (2006.01) |
| ***F01D 25/24*** | (2006.01) |

(52) U.S. Cl.

CPC ..... *F01D 21/003* (2013.01); *F01D 9/041* (2013.01); *F01D 11/003* (2013.01); *F01D 25/24* (2013.01); *F05D 2220/32* (2013.01); *F05D 2260/30* (2013.01); *F05D 2260/80* (2013.01); *F05D 2260/941* (2013.01)

(58) Field of Classification Search

CPC ..... F01D 21/003; F01D 9/041; F01D 25/24; F01D 11/003; F05D 2260/941; F05D 2260/80; F05D 2260/30; F05D 2220/32

See application file for complete search history.

(56) References Cited

U.S. PATENT DOCUMENTS

| | | | | |
|---|---|---|---|---|
| 3,936,217 A * | 2/1976 | Travaglini | F01D 21/003 415/118 |
| 5,431,534 A * | 7/1995 | Charbonnel | F01D 21/003 415/118 |
| 5,867,976 A * | 2/1999 | Ziegler, Jr. | F01D 21/003 415/118 |
| 6,468,033 B1 * | 10/2002 | Weidlich | F01D 17/02 415/118 |
| 9,046,003 B2 | 6/2015 | Twell | |
| 9,574,599 B2 * | 2/2017 | Marc | F01D 21/003 |
| 9,926,802 B2 | 3/2018 | Coles | |

FOREIGN PATENT DOCUMENTS

WO 2014171994 A2 10/2014

OTHER PUBLICATIONS

European Search Report, European Application No. 17185383.1, dated Dec. 8, 2017, European Patent Office; European Search Report 7 pages.

* cited by examiner

*Primary Examiner* — Justin D Seabe
*Assistant Examiner* — Adam W Brown
(74) *Attorney, Agent, or Firm* — Cantor Colburn LLP

(57) ABSTRACT

A borescope plug for a gas turbine engine includes a base attachable to a case and defining a base cavity, a shank having a base engagement element at a first end of the shank, and a plug member located at a second end of the shank, the plug member configured to plug a borescope aperture in a borescope vane cluster. The base engagement element fits within the base cavity such that the base moveably retains the base engagement element and wherein the base engagement element can move within the base cavity.

12 Claims, 12 Drawing Sheets

BORESCOPE PLUG

BACKGROUND

The subject matter disclosed herein generally relates to gas turbine engines and, more particularly, to borescope plugs for gas turbine engines.

Borescope inspection ports can be used on gas turbine engines to enable and allow visual inspection of internal aircraft engine flowpath hardware with a fiber optic borescope. These borescope ports thereby make possible frequent critical engine inspections that otherwise could not be performed without disassembly of the aircraft engine. As such, borescope ports and attendant inspections can allow increased engine usage between overhaul and thus lowers aircraft engine operating costs. A borescope port is plugged by a borescope plug during operation of the aircraft engine. The borescope plug can be subject to high stresses at a shank of the borescope plug which can lead to decreased life of the borescope plug.

Accordingly, it may be advantageous to provide improved life borescope plugs.

SUMMARY

According to some embodiments, borescope plugs include a base attachable to a case and defining a base cavity, a shank having a base engagement element at a first end of the shank, and a plug member located at a second end of the shank, the plug member configured to plug a borescope aperture in a borescope vane cluster. The base engagement element fits within the base cavity such that the base moveably retains the base engagement element and wherein the base engagement element can move within the base cavity.

In addition to one or more of the features described above, or as an alternative, further embodiments of the borescope plug may include a flange located between the second end of the shank and the plug member, wherein the flange is larger than the borescope aperture.

In addition to one or more of the features described above, or as an alternative, further embodiments of the borescope plug may include a retainer that retains the base engagement element within the base cavity.

In addition to one or more of the features described above, or as an alternative, further embodiments of the borescope plug may include that the retainer is integrally formed with the base.

In addition to one or more of the features described above, or as an alternative, further embodiments of the borescope plug may include that the retainer comprises a crimping feature.

In addition to one or more of the features described above, or as an alternative, further embodiments of the borescope plug may include that the retainer fits around a portion of the shank and keeps the shank and the base movably together while allowing the shank and plug member to rotate about a plug axis.

In addition to one or more of the features described above, or as an alternative, further embodiments of the borescope plug may include that the base includes a first anti-rotation element and the base engagement element includes a second anti-rotation element, wherein the first anti-rotation element engages with the second anti-rotation element such that the shank and plug member are prevented from rotating about a shank axis.

In addition to one or more of the features described above, or as an alternative, further embodiments of the borescope plug may include a seal that sealing engages between the plug member and a wall of the borescope aperture when the plug member is installed into the borescope aperture.

In addition to one or more of the features described above, or as an alternative, further embodiments of the borescope plug may include that the plug member includes a seal recess that receives and retains the seal therein.

According to another embodiment, a gas turbine engine includes a case having a case aperture, a borescope vane cluster installed on an inner diameter of the case proximate the case aperture and having a borescope aperture, and a borescope plug. The borescope plug includes a base fixedly attached to the case and defining a base cavity, a shank having a base engagement element at a first end of the shank, and a plug member located at a second end of the shank, the plug member plugging the borescope aperture in the borescope vane cluster. The base engagement element fits within the base cavity such that the base moveably retains the base engagement element and wherein the base engagement element can move within the base cavity.

In addition to one or more of the features described above, or as an alternative, further embodiments of the gas turbine engine may include that the borescope plug further includes a flange located between the second end of the shank and the plug member, wherein the flange is larger than the borescope aperture.

In addition to one or more of the features described above, or as an alternative, further embodiments of the gas turbine engine may include that the borescope plug further includes a retainer that retains the base engagement element within the base cavity.

In addition to one or more of the features described above, or as an alternative, further embodiments of the gas turbine engine may include that the retainer is integrally formed with the base.

In addition to one or more of the features described above, or as an alternative, further embodiments of the gas turbine engine may include that the retainer comprises a crimping feature.

In addition to one or more of the features described above, or as an alternative, further embodiments of the gas turbine engine may include that the retainer fits around a portion of the shank and keeps the shank and the base movably together while allowing the shank and plug member to rotate about a plug axis.

In addition to one or more of the features described above, or as an alternative, further embodiments of the gas turbine engine may include that the base includes a first anti-rotation element and the base engagement element includes a second anti-rotation element, wherein the first anti-rotation element engages with the second anti-rotation element such that the shank and plug member are prevented from rotating about a shank axis.

In addition to one or more of the features described above, or as an alternative, further embodiments of the gas turbine engine may include that the borescope plug further includes a seal that sealing engages between the plug member and a wall of the borescope aperture when the plug member is installed into the borescope aperture.

In addition to one or more of the features described above, or as an alternative, further embodiments of the gas turbine engine may include that the plug member includes a seal recess that receives and retains the seal therein.

Technical effects of embodiments of the present disclosure include a multiple part borescope plug having a separate mounting plate or base and shank/plug section.

The foregoing features and elements may be executed or utilized in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
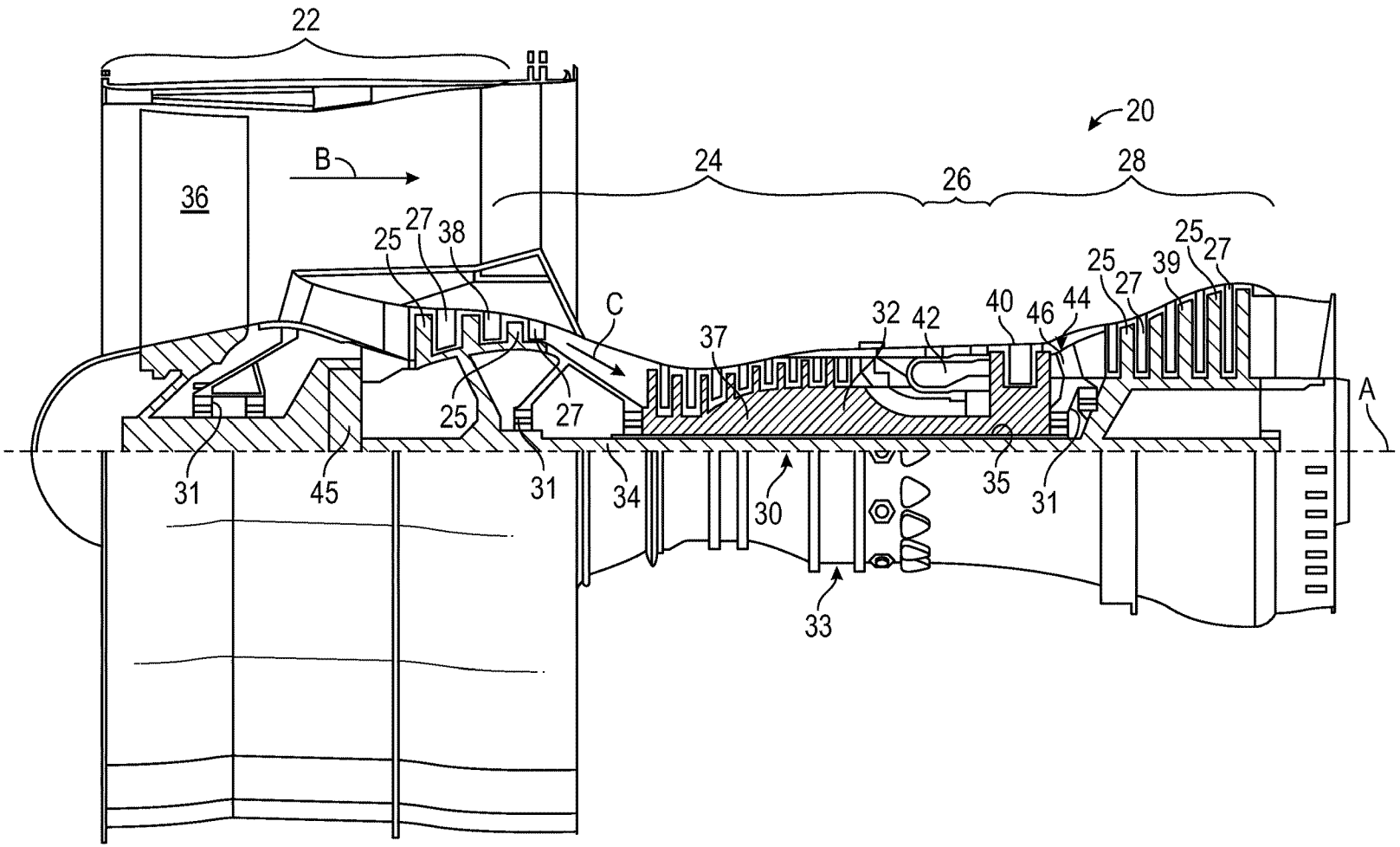
FIG. 1A is a schematic cross-sectional illustration of a gas turbine engine architecture that may employ various embodiments disclosed herein.

As shown and described herein, various features of the disclosure will be presented. Various embodiments may have the same or similar features and thus the same or similar features may be labeled with the same reference numeral, but preceded by a different first number indicating the Figure Number to which the feature is shown. Thus, for example, element "##" that is shown in FIG. X may be labeled "X##" and a similar feature in FIG. Z may be labeled "Z##." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. A bypass ratio (BPR) of a gas turbine engine is the ratio between the mass flow rate of air drawn through the fan disk that bypasses the engine core (uncombusted air) to the mass flow rate passing through the engine core (combusted air). For example, a 10:1 bypass ratio means that 10 kg of air passes around the core for every 1 kg of air passing through the core. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies add or extract energy from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as airflow bleed ports are discussed below.

Figure 1B:
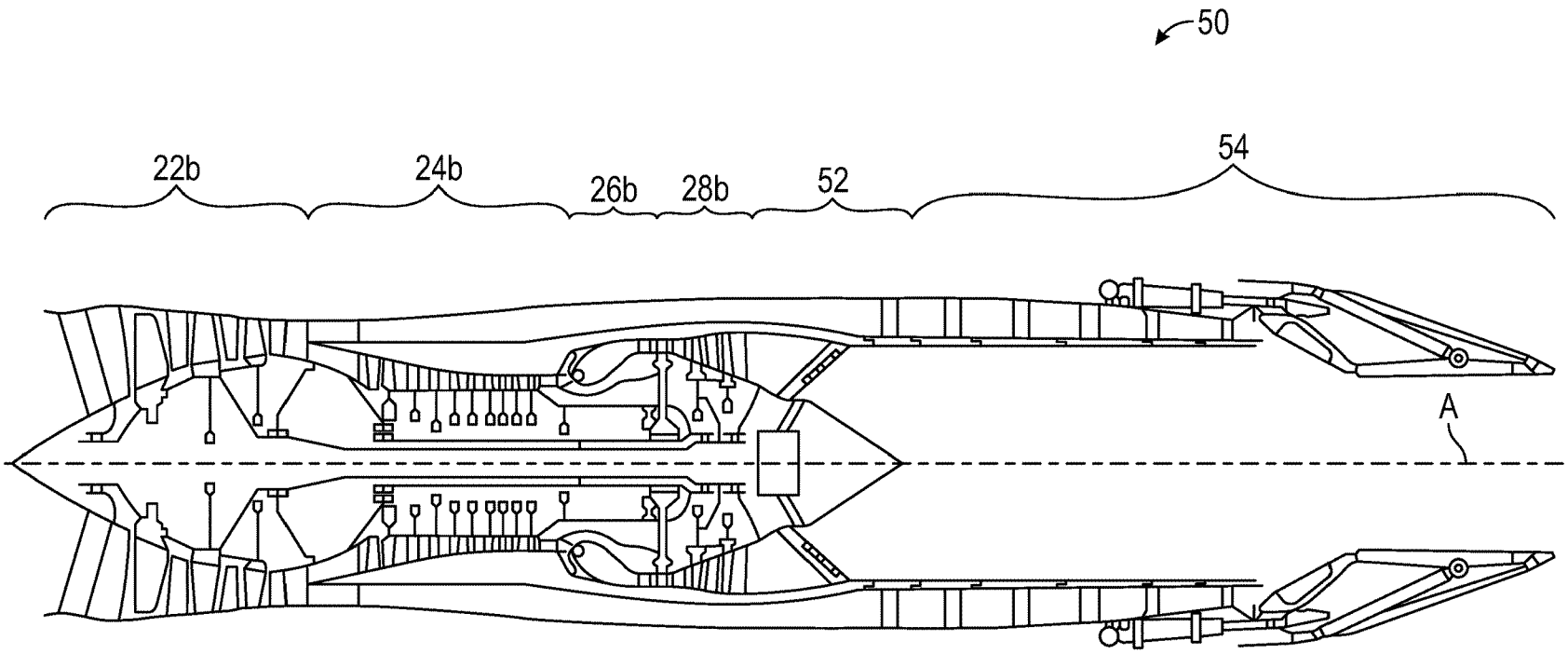
FIG. 1B is a schematic cross-sectional illustration of another gas turbine engine architecture that may employ various embodiments disclosed herein.

Referring to FIG. 1B, an alternative engine architecture of a gas turbine engine 50 may also include an augmentor section 52 and an exhaust duct section 54 among other systems or features. Otherwise, the engine architecture of the gas turbine engine 50 may be similar to that shown in FIG. 1A. That is, the gas turbine engine 50 includes a fan section 22*b* that drives air along a bypass flowpath while a compressor section 24*b* drives air along a core flowpath for compression and communication into a combustor section 26*b* then expansion through a turbine section 28*b*.

Although two architectures for gas turbine engines are depicted (e.g., turbofan in FIG. 1A, low bypass augmented turbofan FIG. 1B) in the disclosed non-limiting embodiments, it should be understood that the concepts described herein are not limited to use with the shown and described configurations, as the teachings may be applied to other types of engines such as, but not limited to, turbojets, turboshafts, and three-spool (plus fan) turbofans wherein an intermediate spool includes an intermediate pressure compressor ("IPC") between a low pressure compressor ("LPC") and a high pressure compressor ("HPC"), and an intermediate pressure turbine ("IPT") between the high pressure turbine ("HPT") and the low pressure turbine ("LPT").

Figure 2:
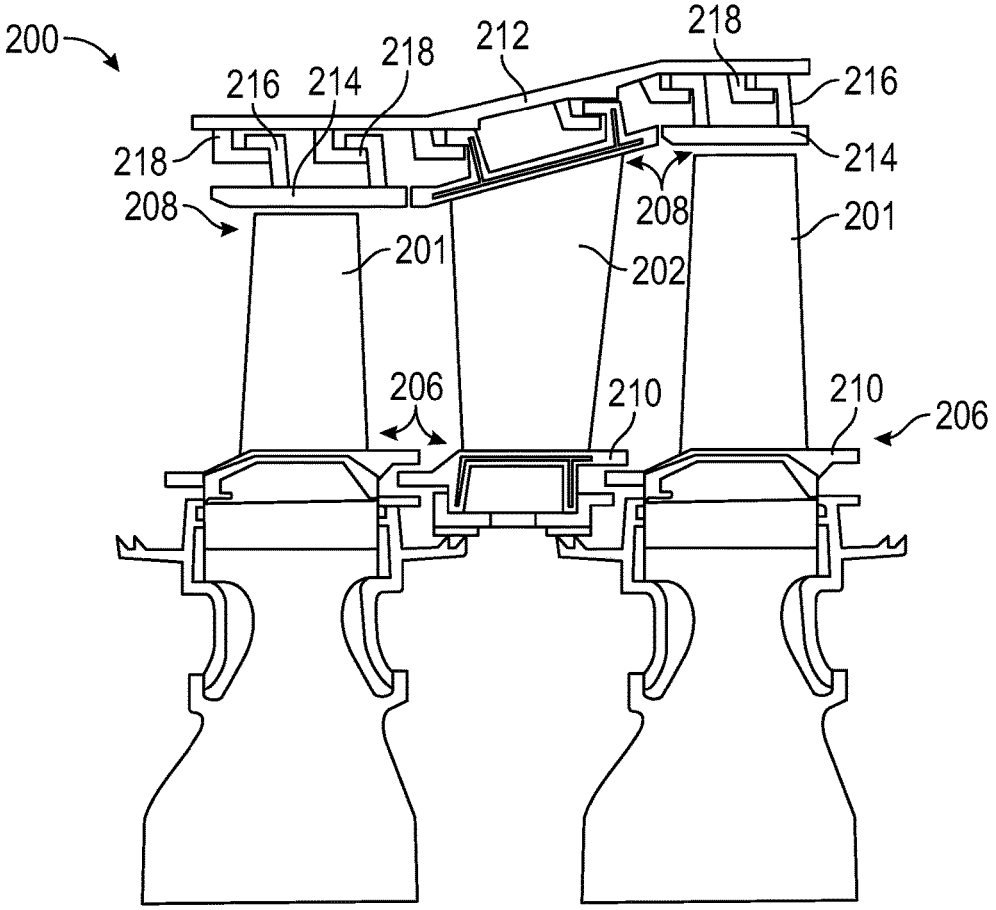
FIG. 2 is a schematic illustration of a section of a gas turbine engine that may employ various embodiments disclosed herein.

FIG. 2 is a schematic view of a turbine section that may employ various embodiments disclosed herein. Turbine 200 includes a plurality of airfoils, including, for example, one or more blades 201 and vanes 202. The airfoils 201, 202 may be hollow bodies with internal cavities defining a number of channels or cavities, hereinafter airfoil cavities, formed therein and extending from an inner diameter 206 to an outer diameter 208, or vice-versa. The airfoil cavities may be separated by partitions within the airfoils 201, 202 that may extend either from the inner diameter 206 or the outer diameter 208 of the airfoil 201, 202. The partitions may extend for a portion of the length of the airfoil 201, 202, but may stop or end prior to forming a complete wall within the airfoil 201, 202. Thus, each of the airfoil cavities may be fluidly connected and form a fluid path within the respective airfoil 201, 202. The blades 201 and the vanes 202 may include platforms 210 located proximal to the inner diameter thereof. Located below the platforms 210 may be airflow ports and/or bleed orifices that enable air to bleed from the internal cavities of the airfoils 201, 202. A root of the airfoil may connected to or be part of the platform 210.

The turbine 200 is housed within a case 212, which may have multiple parts (e.g., turbine case, diffuser case, etc.). In various locations, components, such as seals, may be positioned between airfoils 201, 202 and the case 212. For example, as shown in FIG. 2, blade outer air seals 214 (hereafter "BOAS") are located radially outward from the blades 201. As will be appreciated by those of skill in the art, the BOAS 214 can include BOAS supports that are configured to fixedly connect or attach the BOAS 214 to the case 212 (e.g., the BOAS supports can be located between the BOAS and the case). As shown in FIG. 2, the case 212 includes a plurality of hooks 218 that engage with the hooks 216 to secure the BOAS 214 between the case 212 and a tip of the blade 201.

Figure 3A:
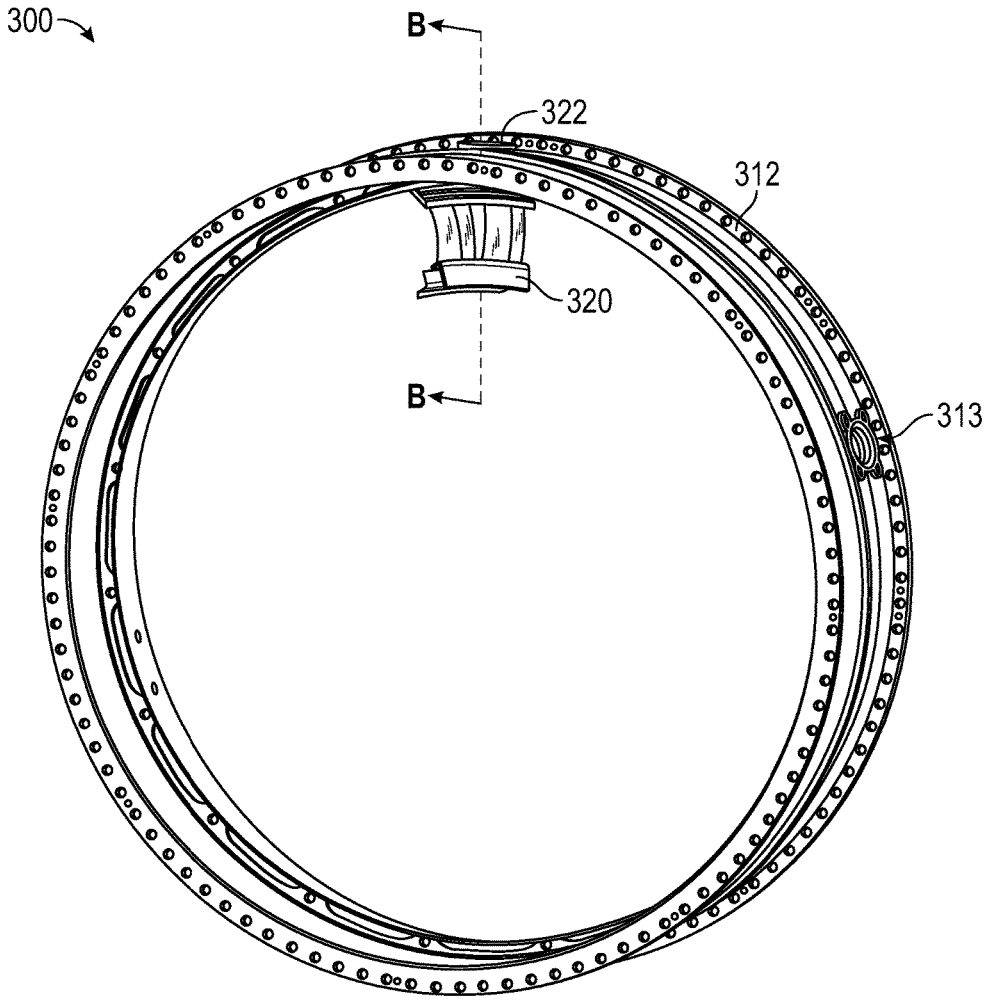
FIG. 3A is an isometric illustration of a case of a turbine having a borescope vane cluster installed on an inner diameter of the case.
Figure 3B:
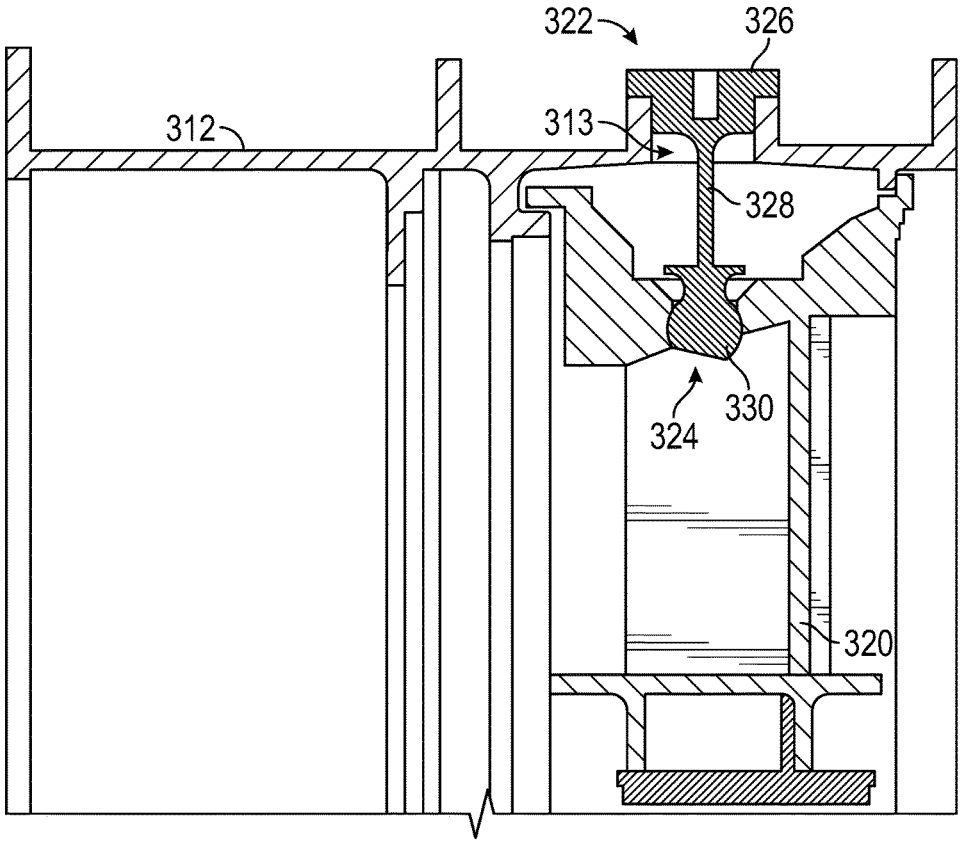
FIG. 3B is a cross-sectional illustration of the case of FIG. 3A as viewed along the line B-B of FIG. 3A.
Figure 3C:
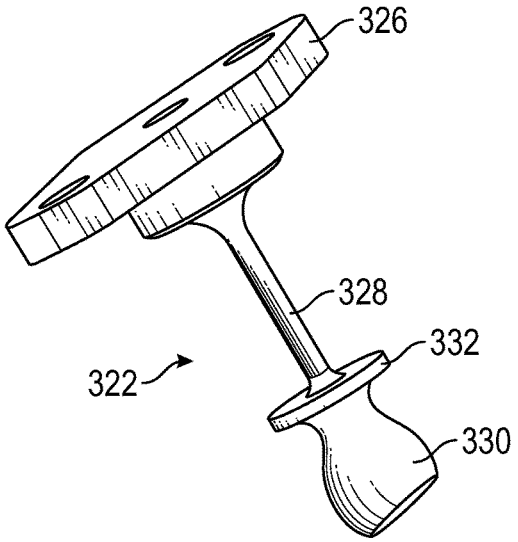
FIG. 3C is an isometric illustration of a borescope plug.

Turning now to FIGS. 3A-3C, schematic illustrations of a turbine 300 having a borescope vane cluster 320 and a borescope plug 322 are shown. FIG. 3A is a schematic illustration of the borescope vane cluster 320 installed to a case 312, with other vanes omitted for clarity. As shown in FIG. 3A, a borescope plug 322 is installed through a case aperture 313 of the case 312 and into the borescope vane cluster 320 and plugs a borescope aperture 324 of the borescope vane cluster 320.

FIG. 3B is a cross-sectional illustration of the borescope vane cluster 320 and borescope plug 322 as viewed along the line B-B of FIG. 3A. As shown, the borescope vane cluster 320 includes a borescope aperture 324 in an outer diameter of the borescope vane cluster 320. The borescope aperture 324 is designed to allow a borescope to be inserted therethrough so that inspection of the turbine 300 or portions thereof can be carried out. During operation of the turbine 300 the borescope aperture 324 is plugged with a borescope plug 322, shown in isometric view in FIG. 3C separate from the turbine 300. The borescope plug 322 includes a base or mounting plate 326, a shank 328 extending from the base 326, and a plug member 330 at an end of the shank 328. As shown, the borescope plug 322 is a unitary piece that is installed into the borescope vane cluster 320 through the case 312. The base 326 of the borescope plug 322 is fixedly attached or connected to an outer diameter of the case 312, and the shank 328 and plug member 330 extend inward such that the plug member can plug or otherwise engage with the borescope aperture 324 of the borescope vane cluster 320.

As shown in FIG. 3C, the borescope plug 322 includes a flange 332 located between the plug member 330 and the shank 328. The flange 332 is optional and can be provided to prevent the plug member 330 from falling into the borescope vane cluster 320 if the shank 328 breaks or otherwise fails such that the plug member 330 separates from the shank 328 and/or the base 326.

During operation, the borescope plug 322 can be subject to high stresses at the shank 328. The shank 328 thus can have a limiting life cycle. The embodiment shown in FIGS. 3A-3C of the borescope plug 320 does not allow movement of the shank 328 and plug member 330 relative to the base 326. Because the position of the shank 328 is fixed relative to the base 326, some of the loads experienced by the vanes of the borescope vane cluster 320 can be transferred to the shank 328, which can result in decreased life of the borescope plug 322. For example, turbine stator (vane) loads from gas-path forces, vibration, and thermal gradient between the stator and the outer mounting case can be transmitted from the plug member 330 to the base 326 of the borescope plug 322 through the shank 328.

Figure 4A:
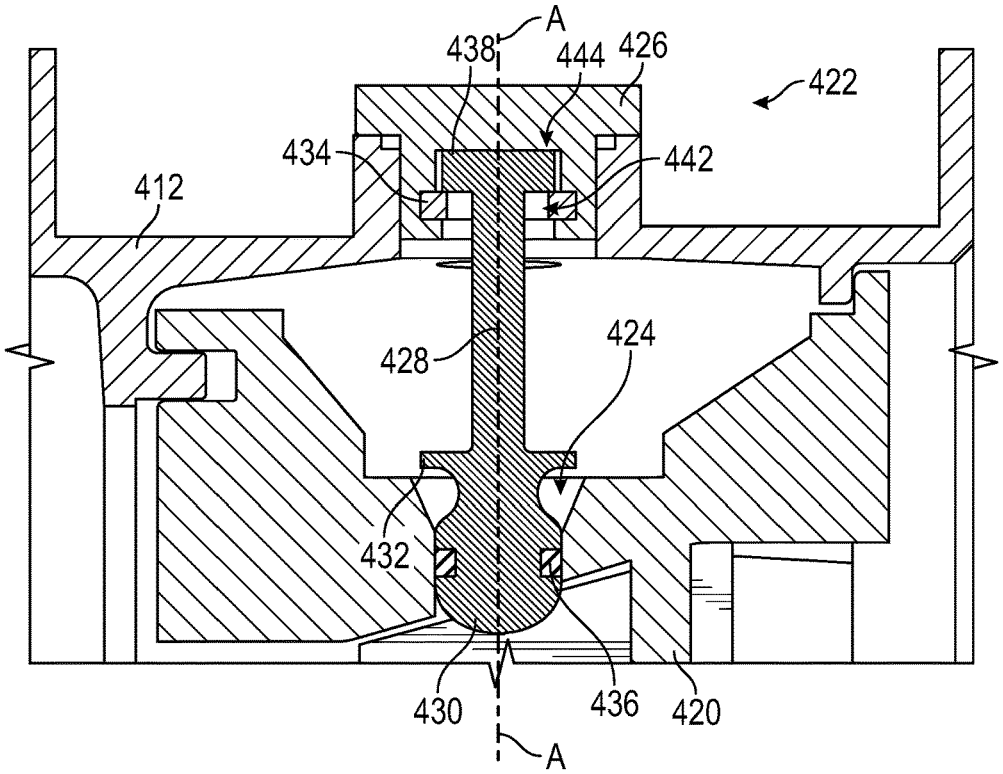
FIG. 4A is a cross-sectional illustration of a borescope plug in accordance with an embodiment of the present disclosure.
Figure 4B:
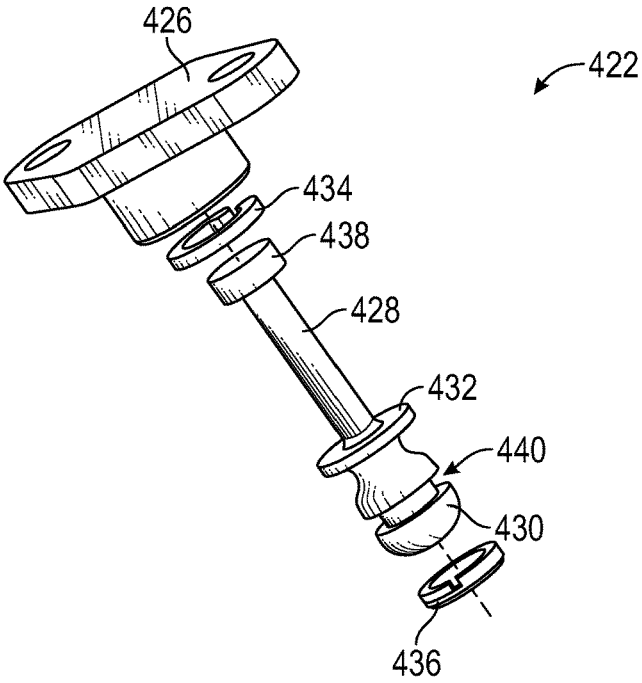
FIG. 4B is an exploded, isometric illustration of the borescope plug of FIG. 4A.

Turning now to FIGS. 4A-4B, an example non-limiting embodiment of a borescope plug 422 in accordance with the present disclosure is shown. FIG. 4A is a cross-sectional illustration of the borescope plug 422 as installed into a case 412 and plugging or engaged with and into a borescope aperture 424 of a borescope vane cluster 420. FIG. 4B is an exploded isometric illustration of the borescope plug 422.

As shown, the borescope plug 422 includes a base 426, a shank 428, and a plug member 430. However, in contrast to the embodiment shown in FIGS. 3A-3C, the borescope plug 422 of FIGS. 4A-4B separates the base 426 and the shank 428. Accordingly, the shank 428, and thus the plug member 430, can move relative to the base 426. The base 426 is fixedly attached or otherwise connected to the case 412 and the plug member 430 and shank 428 can move relative thereto.

As shown in FIGS. 4A-4B, the borescope plug 422 includes the base 426, a retainer 434, the shank 428 having the plug member 430 on an end opposite the base 426, and a seal 436. The shank 428 has a base engagement element 438 at a first end of the shank 428 and the plug member 430 is at a second (opposite) end of the shank 428. The shank 428 further includes an optional flange 432, similar to that described above, located at the second end of the shank 428 between the shank 428 and the plug member 430. The plug member 430, as shown, includes an optional seal recess 440 that is configured to receive the seal 436. The seal 436 is configured to provide sealing engagement between the plug member 430 and the walls of the borescope aperture 424 that passes through an outer diameter of the borescope vane cluster 420.

As shown, the retainer 434 fits around a portion of the shank 428 and keeps the shank 428 and the base 426 together while allowing the shank 428 and plug member 430 to rotate about a plug axis A. The retainer 434 has a retainer aperture 442 that is wide enough to enable the shank 428 to pass therethrough and also enable movement of the shank 428 within the retainer aperture 442. However, the retainer aperture 442 has a smaller diameter or shape than a diameter or shape of the base engagement element 438. The base engagement element 438 fits within a base cavity 444 of the base 426 that is configured to receive the base engagement element 438. The base engagement element 438 is sized to be smaller than the base cavity 444 such that the shank 428 can rotate about the shank axis A.

Furthermore, the base engagement element 438 is sized such that movement of the base engagement element 438 within the base cavity 444 is possible. Accordingly, in addition to rotational movement about the shank axis A, the base engagement element 438 is enabled to move laterally or in a plane perpendicular to the shank axis A. That is, the base engagement element 438 can translate across a plane parallel to a surface of the base 426. Because the shank 428 can rotate, the plug member 430 is modified to have a round geometry such that the same shape of the plug member 430 always extends into a flow path of the borescope vane cluster 420 and the seal 436 prevents gas path air ingestion through the borescope aperture 424.

In some embodiments, the shape of the base of embodiments of the present disclosure may not be flat (e.g., as shown in the figures). That is, in some embodiments, the base may have a curved or other shape or contour such that the base does not define a plane. However, the base cavity in various embodiments can be sized and shaped to receive a base engagement element and allow for movement of the base engagement element within the base cavity. Thus, the illustrations presented herein are merely for illustrative and explanatory purposes and are not intended to be limiting.

Figure 5A:
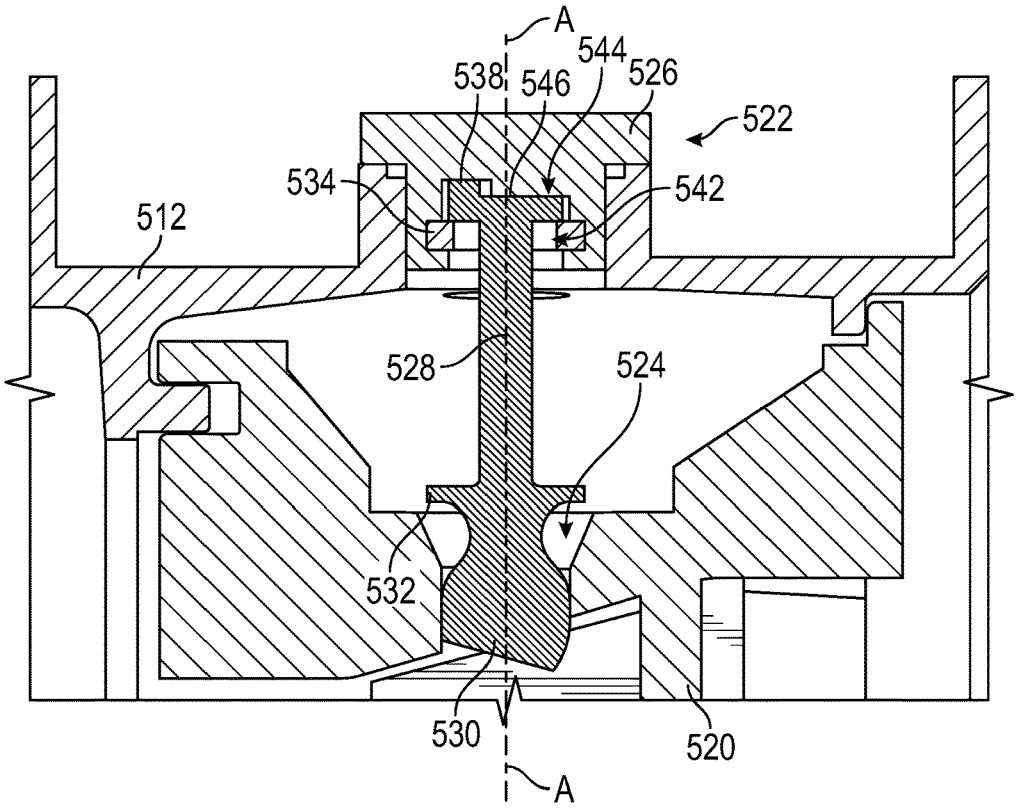
FIG. 5A is a cross-sectional illustration of a borescope plug in accordance with another embodiment of the present disclosure.
Figure 5B:
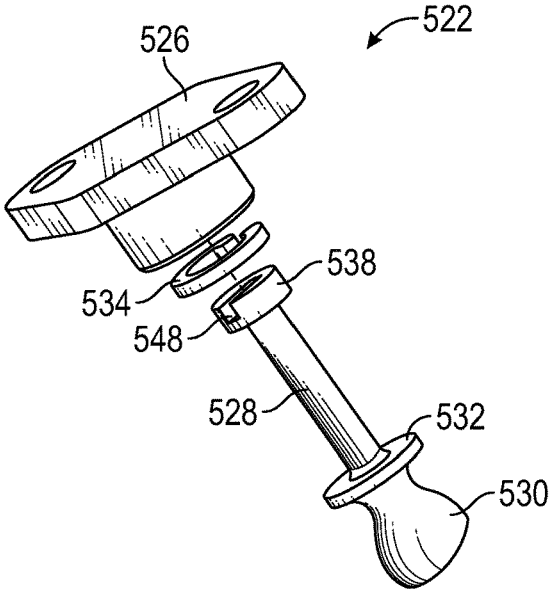
FIG. 5B is an exploded, isometric illustration of the borescope plug of FIG. 5A.
Figure 5C:
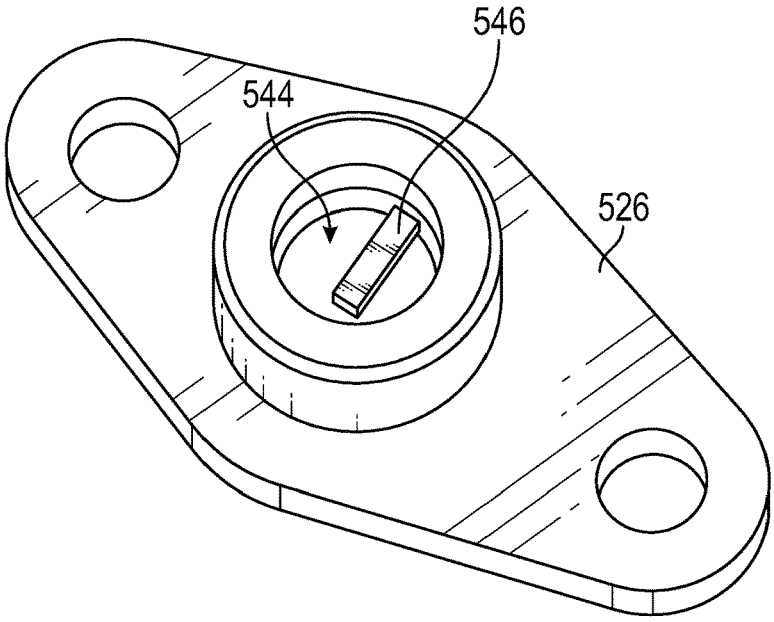
FIG. 5C is an isometric illustration of a base of the borescope plug of FIG. 5A.
Figure 5D:
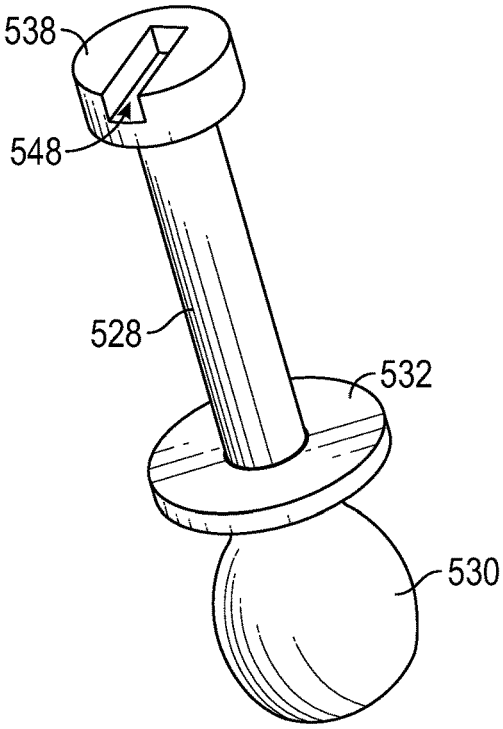
FIG. 5D is an isometric illustration of a shank of the borescope plug of FIG. 5A.

Turning now to FIGS. 5A-5D, another non-limiting embodiment of a borescope plug in accordance with the present disclosure is shown. FIG. 5A is a cross-sectional illustration of a borescope plug 522 as installed into a case 512 and plugging or engaged with and into a borescope aperture 524 of a borescope vane cluster 520. FIG. 5B is an exploded isometric illustration of the borescope plug 522. FIG. 5C is an isometric illustration of a base 526 of the borescope plug 522 and FIG. 5D is an isometric illustration of a base engagement element 538, shank 528, and plug member 530 of the borescope plug 522.

Similar to that shown in FIGS. 4A-4B, the borescope plug 522 includes a base engagement element 538 that engages within a base cavity 544 of the base 526. A retainer 534 is configured to retain the shank 528 and plug member 530 to the base 526. The borescope plug 522 further includes an optional flange 532, as described above.

As described with respect to FIGS. 4A-4B, the shank 428 and plug member 430 were rotatable about the shank axis A. In contrast, the shank 528 and plug member 530 of the embodiment of FIGS. 5A-5D is prevented from rotation about the shank axis A. However, the base engagement element 538 is permitted to move within the base cavity 544.

As shown in FIGS. 5C-5D, anti-rotation elements are provided in the engagement between the base engagement element 538 and the base 526. The base includes a first anti-rotation element 546 and the base engagement element 538 includes a second anti-rotation element 548. The anti-rotation elements 546, 548 are configured to operate together to prevent rotation of the shank 528 relative to the base 526. As shown, the first anti-rotation element 546 on the base 526 is located within the base cavity 544 and is formed as a protrusion. The second anti-rotation element 548 of the base engagement element 538, as shown, is a recess that is sized and shaped to receive the first anti-rotation element 546. Although shown with a protrusion on the base and a recess on the base engagement element, those of skill in the art will appreciate that the opposite may be employed without departing from the scope of the present disclosure. Furthermore, although shown as a slot and protrusion configuration, those of skill in the art will appreciate that any shape, size, and/or geometry of one or both of the first and second anti-rotation elements can be employed without departing from the scope of the present disclosure. In some embodiments, the anti-rotation elements can comprise a pin or other structure that is fixed relative to the base and set offset from an axis or centerline of the shank in order to prevent and/or control rotation of the shank relative to the base.

In the embodiment of FIGS. 5A-5D, although rotation about the shank axis A is prevented, the base engagement element 538 is enabled to move within the base cavity 544. For example, movement within a plane that is parallel to a surface or face of the base 526 and/or perpendicular to the shank axis A can be enabled. Thus, for example, lateral movement of the base engagement element 538 within the base cavity 544 is possible while rotation of the shank 528 is prevented.

Figure 6A:
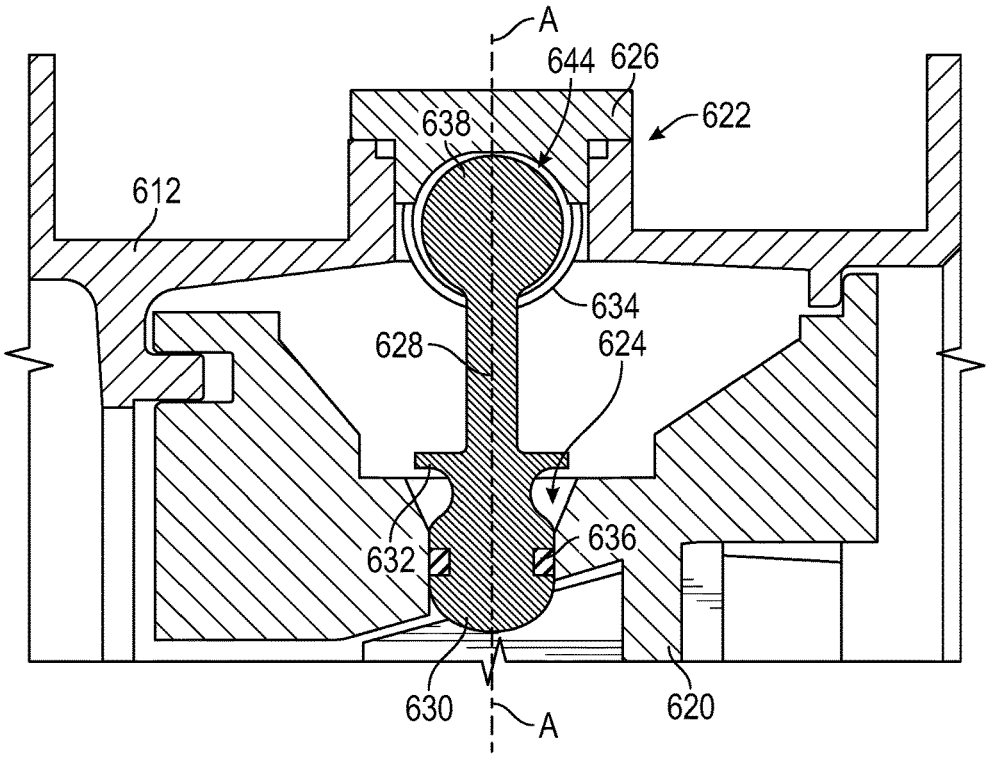
FIG. 6A is a cross-sectional illustration of a borescope plug in accordance with another embodiment of the present disclosure.
Figure 6B:
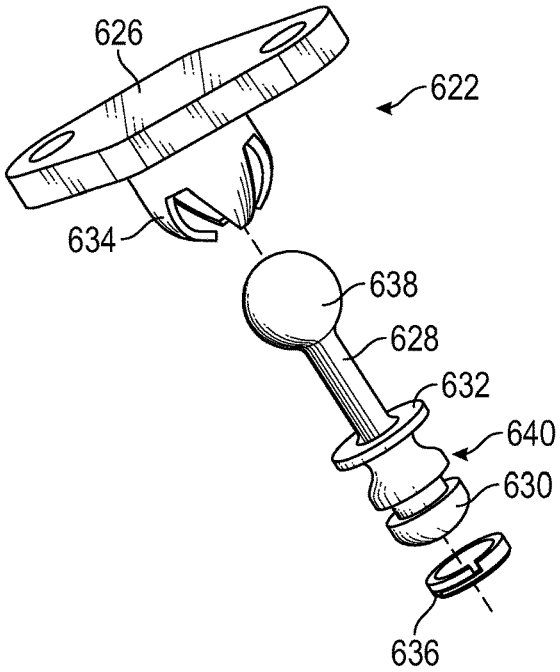
FIG. 6B is an exploded, isometric illustration of the borescope plug of FIG. 6A.
Figure 6C:
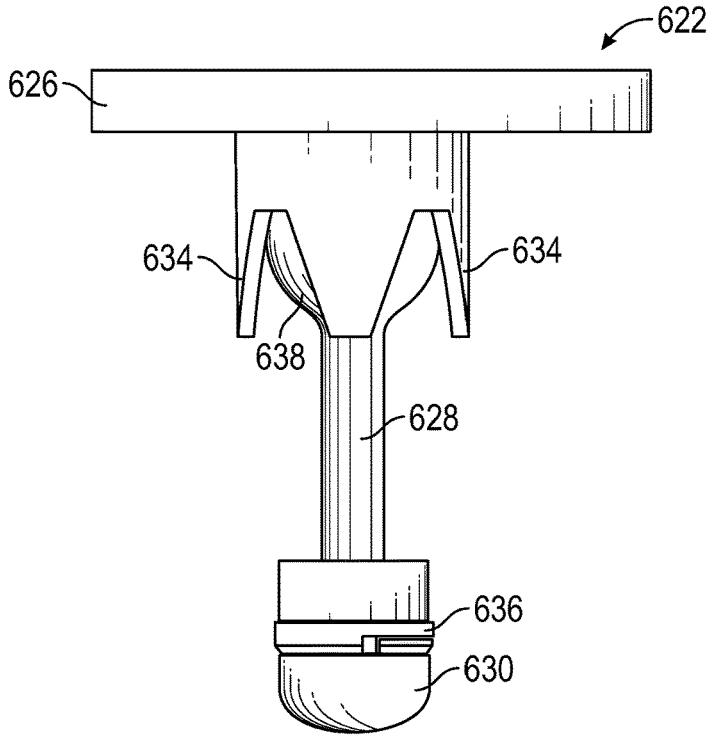
FIG. 6C is a side elevation illustration of the borescope plug of FIG. 6A in a first, open state.
Figure 6D:
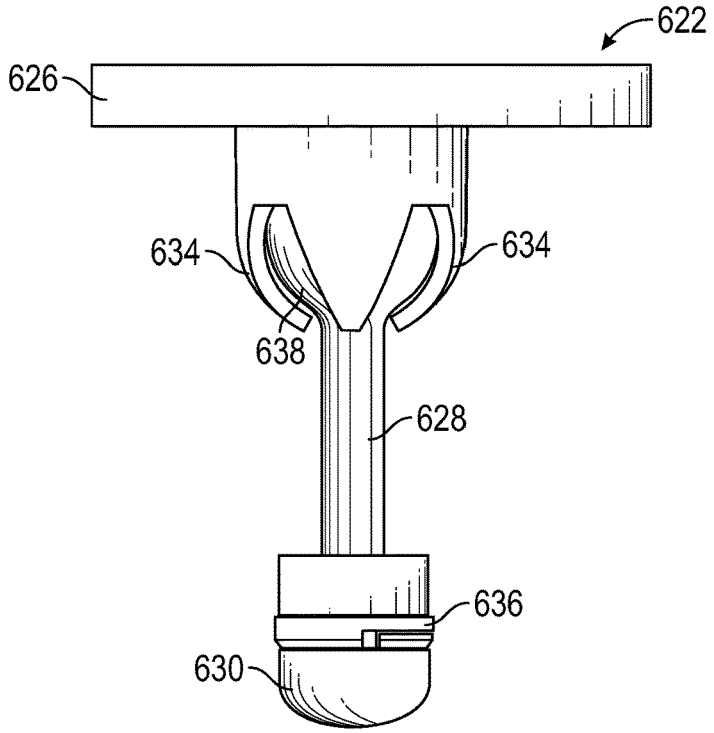
FIG. 6D is a side elevation illustration of the borescope plug of FIG. 6A in a second, closed state.
Figure 7A:
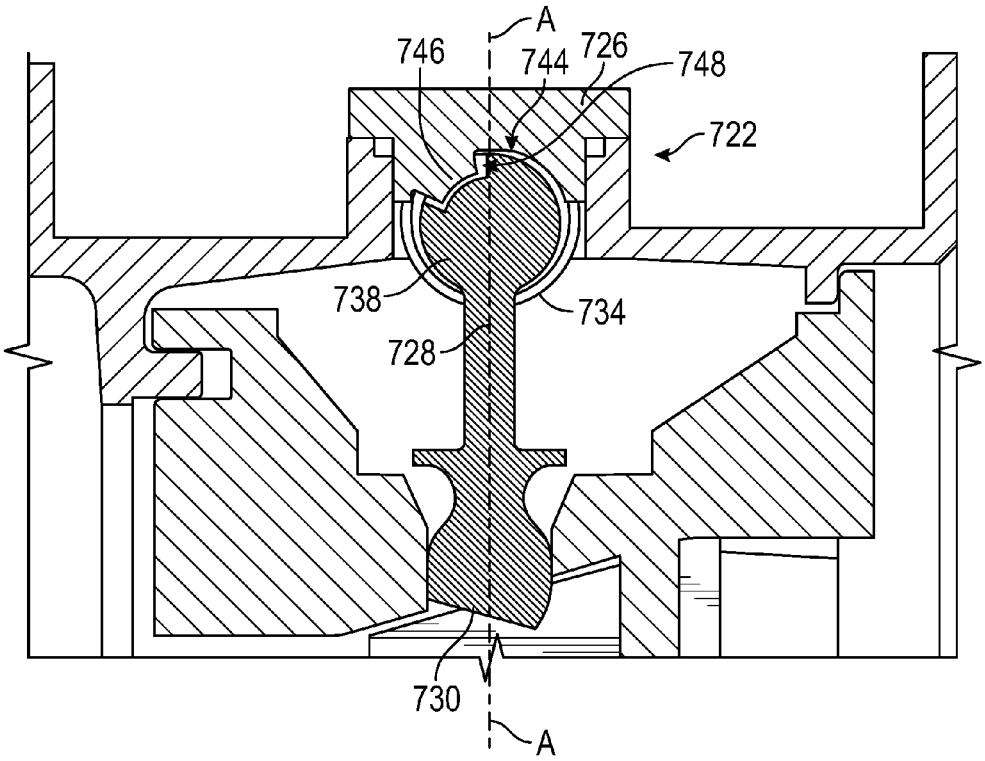
FIG. 7A is a cross-sectional illustration of a borescope plug in accordance with another embodiment of the present disclosure.
Figure 7B:
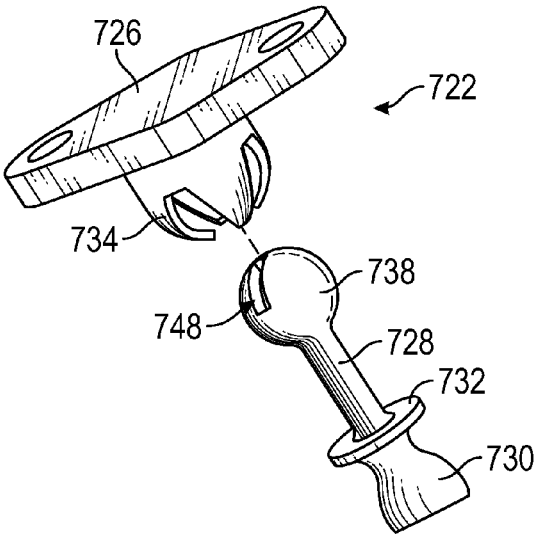
FIG. 7B is an exploded, isometric illustration of the borescope plug of FIG. 7A.
Figure 7C:
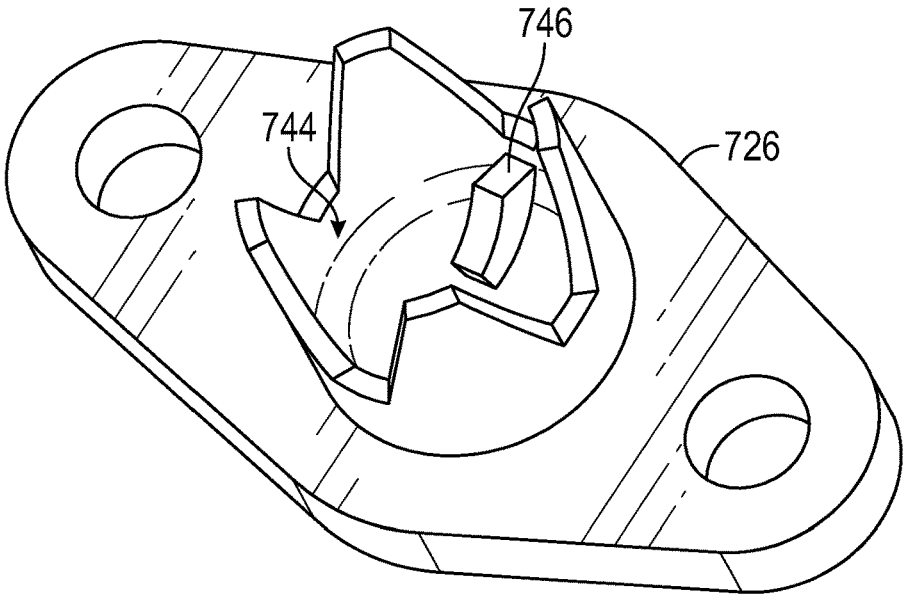
FIG. 7C is an isometric illustration of a base of the borescope plug of FIG. 7A.
Figure 7D:
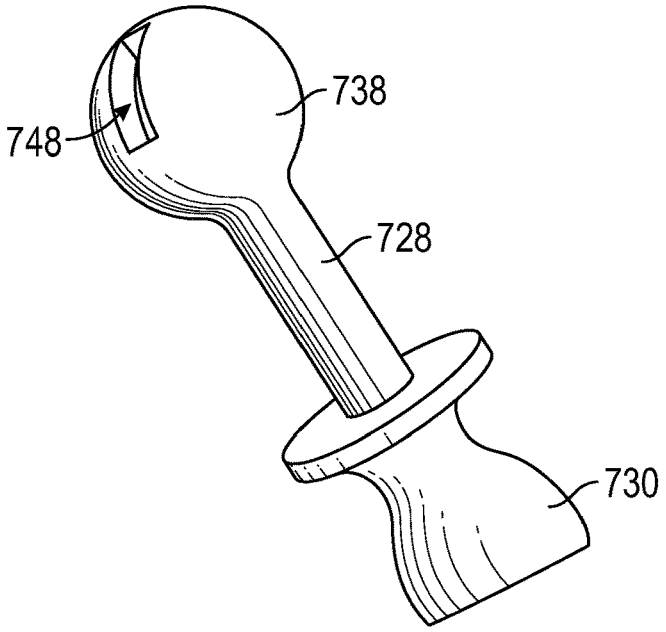
FIG. 7D is an isometric illustration of a shank of the borescope plug of FIG. 7A.

Turning now to FIGS. 6A-6D, another example non-limiting embodiment of a borescope plug 622 in accordance with the present disclosure is shown. FIG. 6A is a cross-sectional illustration of the borescope plug 622 as installed into a case 612 and plugging or engaged with and into a borescope aperture 624 of a borescope vane cluster 620. FIG. 6B is an exploded isometric illustration of the borescope plug 622. FIG. 6C is an illustration of the borescope plug 622 in a first state (e.g., open) and FIG. 6D is an illustration of the borescope plug 622 in a second state (e.g., closed).

As shown, the borescope plug 622 includes a base 626, a shank 628, and a plug member 630. As shown, the base 626 and the shank 628 are separate components. Accordingly, the shank 628, and thus the plug member 630, can move relative to the base 626. The base 626 is fixedly attached or otherwise connected to the case 612 and the plug member 630 and shank 628 can move relative thereto.

As shown in FIGS. 6A-6D, the borescope plug 622 includes the base 626, the shank 628 having the plug member 630 on an end opposite the base 626, and a seal 636. In contrast to the previously described embodiments, the retainer 634 is integrated into the base 626, and is not a separate element as shown in the prior embodiments.

The shank 628 has a base engagement element 638 at a first end of the shank 628 and the plug member 630 is at a second (opposite) end of the shank 628. The shank 628 further includes an optional flange 632 (shown in FIG. 6B, and omitted in FIGS. 6C-6D), similar to that described above, located at the second end of the shank 628 between the shank 628 and the plug member 630. The plug member 630, as shown, includes an optional seal recess 640 that is configured to receive the seal 636. The seal 636 is configured to provide sealing engagement between the plug member 630 and the walls of the borescope aperture 624 that passes through an outer diameter of the borescope vane cluster 620.

As shown, the integral retainer 634 defines the base cavity 644 fits around a portion of the shank 628 and keeps the shank 628 and the base 626 together while allowing the shank 628 and plug member 630 to rotate about a plug axis A. The retainer 634, as shown, includes crimping features or fingers that can be open to receive the base engagement element 638 of the shank 628 and then close about the base engagement element 638 to secure the shank 628 to the base 626. The integral retainer 634 is configured to enable movement of the base engagement element 638, and thus the shank 628, within the integral retainer 634. The base engagement element 438 is sized to be smaller than the base cavity 644 of the integral retainer 634 such that the shank 628 can rotate about the shank axis A.

Furthermore, the base engagement element 638 is sized such that movement of the base engagement element 638 within the base cavity 644 is possible. That is, for example, in addition to rotational movement about the shank axis A, the base engagement element 638 is enabled to move in a plane perpendicular to the shank axis A. Stated another way, the base engagement element 638 can translate across a plane parallel to a surface of the base 626. Because the shank 628 can rotate, the plug member 630 is modified to have a round geometry such that the same shape of the plug member 630 always extends into a flow path of the borescope vane cluster 620 and the seal 636 prevents gas path air ingestion through the borescope aperture 624.

Turning now to FIGS. 7A-7D, another embodiment of the present disclosure is shown. FIGS. 7A-7D illustrate a borescope plug 722 that combines features of previously described embodiments. As shown, the borescope plug 722 includes a base 726, a shank 728, and a plug member 730. The shank 726 includes a base engagement element 738 that fits within a base cavity 744 such that the shank 728 can be movably attached to the base 726. In the embodiment of FIGS. 7A-7D, the base 726 includes a first anti-rotation element 746 within the base cavity 744 and the base engagement element 738 includes a mating or corresponding second anti-rotation element 748 such that when the base engagement element 738 is engaged within the base cavity 744 and the retainer 734 is engaged, the shank 728 is prevented from rotation about the shank axis A but lateral movement is enabled, as described above.

Although shown and described above with respect to certain configurations, orientations, geometries, etc., those of skill in the art will appreciate that variations can be implemented without departing from the scope of the present disclosure. For example, although shown as a circular or semi-spherical, the base engagement element can take any shape or geometry. For example, in some embodiments, the base engagement element can be squared or otherwise include a flat or engaging surface that prevents rotation of the shank while allowing for lateral movement.

Further, although described with respect to a borescope plug, those of skill in the art will appreciate that various embodiments and concepts provided herein can be applied to any type of plugging configuration wherein high stresses are possible on a shank of a plug structure.

Advantageously, embodiments described herein provide an improved plug configuration that reduces or eliminate high stresses that are applied to one or more components of the plug. That is, in accordance with some embodiments, stresses applied to and within a plug can be greatly reduced by separating a plug section (e.g., shank and plug member) from a mounting plate (e.g., base). Further, the two-piece separated design of the plugs provides a fixed/pinned arrangement which allows small axial and tangential relative movement between a vane and a base of the plug.

The use of the terms "a," "an," "the," and similar references in the context of description (especially in the context of the following claims) are to be construed to cover both the singular and the plural, unless otherwise indicated herein or specifically contradicted by context. The modifier "about"

used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although an aero or aircraft engine application is shown and described above, those of skill in the art will appreciate that borescope configurations as described herein may be applied to industrial applications and/or industrial gas turbine engines, land based or otherwise.

Accordingly, the present disclosure is not to be seen as limited by the foregoing description, but is only limited by the scope of the appended claims.

What is claimed is:

1. A borescope plug comprising:

a base attachable to a case and defining a base cavity;

a shank having a base engagement element at a first end of the shank; and a plug member located at a second end of the shank, the plug member configured to plug a borescope aperture in a borescope vane cluster, wherein the base engagement element fits within the base cavity such that the base moveably retains the base engagement element and wherein the base engagement element can move within the base cavity, and an integrally formed retainer that is integrally formed with the base, the integrally formed retainer defining a plurality of fingers defining a portion of the base cavity, the plurality of fingers arranged to receive the base engagement element in the base cavity when in an open position and are closable to movably secure the base engagement element within the base cavity.

2. The borescope plug of claim 1, further comprising a flange located between the second end of the shank and the plug member.

3. The borescope plug of claim 1, wherein the integrally formed retainer fits around the base engagement element and keeps the shank and the base movably together while allowing the shank and plug member to rotate about a plug axis.

4. The borescope plug of claim 1, wherein the base includes a first anti-rotation element and the base engagement element includes a second anti-rotation element, wherein the first anti-rotation element engages with the second anti-rotation element such that the shank and plug member are prevented from rotating about a shank axis.

5. The borescope plug of claim 1, further comprising a seal that sealing engages between the plug member and a wall of the borescope aperture when the plug member is installed into the borescope aperture.

6. The borescope plug of claim 5, wherein the plug member includes a seal recess that receives and retains the seal therein.

7. A gas turbine engine comprising:

a case having a case aperture;

a borescope vane cluster installed on an inner diameter of the case proximate the case aperture and having a borescope aperture; and a borescope plug comprising:

a base fixedly attached to the case and defining a base cavity;

a shank having a base engagement element at a first end of the shank; and a plug member located at a second end of the shank, the plug member plugging the borescope aperture in the borescope vane cluster, wherein the base engagement element fits within the base cavity such that the base moveably retains the base engagement element and wherein the base engagement element can move within the base cavity, and an integrally formed retainer that is integrally formed with the base, the integrally formed retainer defining a plurality of fingers defining a portion of the base cavity, the plurality of fingers arranged to receive the base engagement element in the base cavity when in an open position and are closable to movably secure the base engagement element within the base cavity.

8. The gas turbine engine of claim 7, the borescope plug further comprising a flange located between the second end of the shank and the plug member.

9. The gas turbine engine of claim 7, wherein the integrally retainer fits around the base engagement element and keeps the shank and the base movably together while allowing the shank and plug member to rotate about a plug axis.

10. The gas turbine engine of claim 7, wherein the base includes a first anti-rotation element and the base engagement element includes a second anti-rotation element, wherein the first anti-rotation element engages with the second anti-rotation element such that the shank and plug member are prevented from rotating about a shank axis.

11. The gas turbine engine of claim 7, the borescope plug further comprising a seal that sealing engages between the plug member and a wall of the borescope aperture when the plug member is installed into the borescope aperture.

12. The gas turbine engine of claim 11, wherein the plug member includes a seal recess that receives and retains the seal therein.

* * * * *